US005965011A

United States Patent [19]

Hatanaka et al.

[11] Patent Number: 5,965,011

[45] Date of Patent: Oct. 12, 1999

[54] METHOD FOR REDUCING DEPOSITION OF COKES IN HEAT-REFINING PROCESS OF PETROLEUM HIGH-MOLECULAR HYDROCARBONS, AND ADDITIVE USED IN THE METHOD

[75] Inventors: Toshifumi Hatanaka, Kyoto; Kazuya Hata; Tetsushi Kawamura, both of Tokyo; Hirokazu Itoh, Hyogo; Yoshiro Arita, Osaka, all of Japan

[73] Assignees: Nippon Shokubai Co., Ltd., Japan; Elf Atochem, S.A., France

[21] Appl. No.: 08/883,705

[22] Filed: Jun. 27, 1997

[30] Foreign Application Priority Data

Jun. 28, 1996 [JP] Japan ..... 8-188256

[51] Int. Cl.[6] ..... C10G 9/16; C10G 7/10

[52] U.S. Cl. ..... 208/48 R; 208/48 AA; 585/950

[58] Field of Search ..... 208/48 R, 48 AA, 208/130, 131, 132; 585/648, 649, 950

[56] References Cited

U.S. PATENT DOCUMENTS

| | | | |
|---|---|---|---|
| 4,116,812 | 9/1978 | Godar et al. | 208/48 AA |
| 4,259,474 | 3/1981 | Chakrabarti et al. | 528/388 |
| 4,298,455 | 11/1981 | Huang | 208/48 AA |
| 4,587,007 | 5/1986 | Rudnick | 208/107 |
| 4,931,170 | 6/1990 | Sasaki | 208/348 |
| 5,024,678 | 6/1991 | Mertens-Gottselig et al. | 44/348 |
| 5,271,824 | 12/1993 | Forester et al. | 208/48 AA |
| 5,527,447 | 6/1996 | Roof | 208/48 AA |

FOREIGN PATENT DOCUMENTS

| | | |
|---|---|---|
| 289 785 | 11/1988 | European Pat. Off. . |
| 839 782 | 5/1998 | European Pat. Off. . |
| 62-190285 | 8/1987 | Japan . |
| 62-207394 | 9/1987 | Japan . |
| WO 94/06889 | 3/1994 | WIPO . |

*Primary Examiner*—Bekir L. Yildirim
*Attorney, Agent, or Firm*—Bell, Boyd & Lloyd

[57] ABSTRACT

Method for reducing deposition of cokes in heat-refining process of petroleum high-molecular hydrocarbons, characterized in that heat-treatment in a heating unit is effected in the presence of at least one compound (I) having at least one mercaprtoalkylthio group:

$HS—C_mH_{2m}—S—$ in which "m" is an integer of 2 to 4.

9 Claims, 1 Drawing Sheet

METHOD FOR REDUCING DEPOSITION OF COKES IN HEAT-REFINING PROCESS OF PETROLEUM HIGH-MOLECULAR HYDROCARBONS, AND ADDITIVE USED IN THE METHOD

BACKGROUND OF THE INVENTION

1. Field of the Invention

This invention relates to improvement in heating technique used in heat-refining process of petroleum high-molecular hydrocarbons.

In particular, this invention relates to a method for reducing remarkably deposition of cokes which are produced heating units used in heat-refining process of petroleum high-molecular hydrocarbons, by incorporating an additive for reducing deposition of cokes in the petroleum high-molecular hydrocarbons.

This invention relates also to the additive for reducing deposition of coke in the petroleum high-molecular hydrocarbons.

This invention also relates to a novel use of a compound (I) having at least one mercaprtoalkylthio group: HS—$C_mH_{2m}$—S—, in which "m" is an integer of 2 to 4.

2. Description of Related Art

One of objects of oil refinery is to increase the yield of lighter components such as kerosene and gas oil which are much value added products comparing to heavier components which are less value added products. In fact, in actual oil refinery processes, heavier components such as residual oil from atmospheric distillation column is heat-treated in vacuum distillation column, thermal cracking unit or visbreaking unit to obtain lighter components. These processes and apparatuses are well-known and are described in many books, for example "World Encyclopedia" 13, Heibon-sha, 1966, p 237–254.

The yield of lighter components can be increased by elevating operation temperature in the heating units. However, elevation of operation temperature in the heating units cause a trouble of increment of cokes which deposit on inner walls of heating unit or heat-exchangers, resulting in frequent stop of production plants for maintenance. In particular, in a case of thermal cracking process of heavy oil, heating tubes in a heating furnace are seriously contaminated and are choked with deposited cokes, so that production plant can not be operated continuously but must be stopped frequently for cleaning.

Due to this problem, actual oil refinery plants are compelled to be operated at lower operation temperature than such ideal operation temperature that assure higher yield of lighter components. In other words, operation temperature can not be elevated above certain limit.

Inventors found, surprisingly, such a fact that deposition of cokes can be reduced remarkably by incorporating an additive having speific mercapto alkylthio group in material of petroleum high-molecular hydrocarbons to be refined in heating units used in a variety of oil refining processes, and completed the invention.

SUMMARY OF THE INVENTION

The present invention provides a method for reducing deposition of cokes in heat-refining process of petroleum high-molecular hydrocarbons, characterized in that heat-treatment in a heating unit is effected in the presence of at least one compound (I) having at least one mercaprtoalkylthio group:

HS—$C_mH_{2m}$—S— in which "m" is an integer of 2 to 4.

The present invention provides also an additive for reducing deposition of cokes in heating unit used in heat-refining process of petroleum high-molecular hydrocarbons comprising at least one of the compound (I).

The compound (I) having mercapto alkylthio group can be added to a material of petroleum hydrocarbons before the material is introduced into the heating unit. Timing of addition is not specially limited but the compound (I) is added to the material usually near to an inlet of the heating unit. Mixing of the compound (I) with the material is not necessary. In a variation, the compound (I) with the material of petroleum hydrocarbons may be introduced directly and separately into a heating unit.

The compound (I) having mercapto alkylthio group is added at a proportion of 10 ppm to 1% by weight, preferably 50 ppm to 0.5% by weight, more preferably 100 ppm to 0,1% by weight with respect to petroleum hydrocarbons to be treated. No advantage of the present invention is expected below the lower limit of 10 ppm. Higher proportion above 1% by weight is not excluded but is included in the scope of the present invention. However, excess use of the compound (I) above the upper limit do not improve advantages of the present invention and is not preferable because of increment of advisable sulfur content.

The method according to the present invention is advantageously applicable to an operation temperature between 250 ° C. and 550 ° C., preferably between 350 ° C. and 550 ° C. Operation temperatures of higher than 550 ° C. and lower than 250 ° C. are not excluded in the present invention. However, when the operation temperature becomes lower than 250 ° C., no serious deposition of cokes is observed and hence advantages of the present invention is not remarkable. On the contrary, if the operation temperature exceeds 550 ° C., the compounds (I) having mercapto alkylthio group themselves are decomposed before they function as inhibitor of coke deposition.

Residence time of the compound (I) having mercapto alkylthio group in a heating unit is not specially limited. Usually, the compound (I) having mercapto alkylthio group carried into and then flown out the heating unit together with the material of petroleum hydrocarbons. In fact, in a case that the heating unit is a distillation column, the compound (I) removes the distillation column together with a cut or cuts each withdrawn at predetermined stage between the top and the bottom of the column. Therefore, the residence time of the compound (I) having mercapto alkylthio group according to the present invention in a heating unit is equal to the residence time of the material of petroleum hydrocarbons in oil refinery process, and is usually between 1 to 60 minutes, preferably 10 to 30 minutes.

When a trace of compound (I) having mercapto alkylthio group remained in the final product is not desirable and is requested to be removed, the compound (I) can be removed easily out of the product by the conventional purification technique such as hydrogenation.

The heating unit which is used in the present invention can be any one that are used in the conventional oil refinery process such as atmospheric distillation column, vacuum distillation column, thermal cracking unit and visbreaking unit.

The petroleum high-molecular hydrocarbons to which the present invention is applied is not specially limited but the present invention is advantageously applicable to heavy components whose problem of coke deposition is serious, such as residue of atmospheric distillation column.

The compound (I) having mercapto alkylthio group used in the present invention is understood as a compound having at least one mercaprtoalkylthio group: HS—$C_mH_{2m}$—S— in which mercapto group (HS) and sulfur atom (S) are spaced by an alkylene group ($C_mH_{2m}$) having carbon number of 2 to 4, namely "m" is an integer of 2 to 4. The alkylene group ($C_mH_{2m}$) can be linear chain or branched chain.

The method according to the present invention is advantageously applicable to those having the mercaprtoalkylthio group whose "m" is 2 or 3.

In the method according to the present invention, the compound (I) having mercapto alkylthio group can be used in a form of a mixture or combination.

The compound (I) having mercapto alkylthio group may be compounds represented by the general formula (A):

$$(R_1, R_2, R_3, R_4, R_5, R_6)—(S—C_mH_{2m}—SH)_n \quad (A)$$

in which

"m" is an integer of 2 to 4,

"n" is an integer of 1 to 6, and each of $R_1$, $R_2$, $R_3$, $R_4$, $R_5$ and $R_6$ is organic group and may be bonded each other through one or more than one chemical bonds, and at least one of $R_1$, $R_2$, $R_3$, $R_4$, $R_5$ and $R_6$ must exist in said compound, the total carbon number of $R_1$, $R_2$, $R_3$, $R_4$, $R_5$ and $R_6$ being 2 to 28.

Followings are examples of the compound (I) having mercapto alkylthio group used in the present invention:

$HSCH_2CH_2SCH_2CH_2SH$ $HSCH_2CH_2SCH_2CH_2SCH_2CH_2SH$ $HOCH_2CH_2SCH_2CH_2SH$ $HO(CH_2CH_2S)_xH$ (in which "x" is an integer equal to 3 or higer than 3)

$HO(CH_2CH(CH_3)S)_xH$ (in which "x" is an integer equal to 2 or of higer than 2)

$CH_3SCH_2CH_2SH$ $CH_3SCH_2CH_2SCH_2CH_2SH$ $CH_3CH_2CH_2CH_2SCH_2CH_2SH$ $CH_3SCH_2CH(CH_3)SH$ $CH_3CH_2CH_2CH_2SCH_2CH(CH_3)SH$ $C_6H_5SCH_2CH_2SH$ $C_6H_5SCH_2CH(CH_3)SH$ $CH_3OCOCH_2SCH_2CH_2SH$ $CH_3OCOCH_2SCH_2CH_2SCH_2CH_2SH$ $CH_3OCOCH_2SCH_2CH(CH_3)SH$ $CH_3OCOCH_2SCH_2C(CH_3)_2SH$ $C_8H_{17}OCOCH_2SCH_2CH_2SH$ $CH_3OCOCH_2CH_2SCH_2CH_2SH$ $CH_3OCOCH_2CH_2SCH_2CH_2SCH_2CH_2SH$ $CH_3OCOCH_2CH_2SCH_2CH(CH_3)SH$ $CH_3OCOCH_2CH_2SCH_2CH_2CH_2SH$ $(HSCH_2COOCH_2)_3C(CH_2OCOCH_2SCH_2CH_2SH$ $(HSCH_2COOCH_2)_2C(CH_2OCOCH_2SCH_2CH_2SH)_2$ $(HSCH_2COOCH_2)C(CH_2OCOCH_2SCH_2CH_2SH)_3$ $C(CH_2OCOCH_2SCH_2CH_2SH)_4$ $(HSCH_2CH_2COOCH_2)_3C(CH_2OCOCH_2CH_2SCH_2CH_2SH)$ $(HSCH_2CH_2COOCH_2)_2C(CH_2OCOCH_2CH_2SCH_2CH_2SH)_2$ $HSCH_2CH_2COOCH_2)C(CH_2OCOCH_2CH_2SCH_2CH_2SH)_3$ $C(CH_2OCOCH_2CH_2SCH_2CH_2SH)_4$ $(HOCH_2)_3C(CH_2OCOCH_2CH_2SCH_2CH_2SH)$ $(HOCH_2)_2C(CH_2OCOCH_2CH_2SCH_2CH_2SH)_2$ $(HOCH_2)C(CH_2OCOCH_2CH_2SCH_2CH_2SH)_3$ $(HSCH_2CH_2COOCH_2)_2C(C_2H_5)(CH_2OCOCH_2CH_2SCH_2CH_2SH)$ $(HSCH_2CH_2COOCH_2)C(C_2H_2)(CH_2OCOCH_2CH_2SCH_2CH_2SH)_2$ $C_2H_5C(CH_2OCOCH_2CH_2SCH_2CH_2SH)_3$ $(HOCH_2)_3CCH_2O—CH_2C(CH_2OH)_2(CH_2OCOCH_2CH_2SCH_2CH_2SH)$ $(HSCH_2CH_2SCH_2CH_2COOCH_2)(CH_2OH)_2CCH_2—O—CH_2C(CH_2OH)_2(CH_2OCOCH_2CH_2SCH_2CH_2SH)$ $(HSCH_2CH_2SCH_2CH_2COOCH_2)(CH_2OH)_2CCH_2—O—CH_2C(CH_2OH)(CH_2OCOCH_2CH_2SCH_2CH_2SH)_2$ $(HSCH_2CH_2SCH_2CH_2COOCH_2)_2(CH_2OH)CCH_2—O—CH_2C(CH_2OH)(CH_2OCOCH_2CH_2SCH_2CH_2SH)_2$ $(HSCH_2CH_2SCH_2CH_2COOCH_2)_2(CH_2OH)CCH_2—O—CH_2C(CH_2OCOCH_2CH_2SCH_2CH_2SH)_3$ $(HSCH_2CH_2SCH_2CH_2COOCH_2)_3CCH_2—O—CH_2C(CH_2OCOCH_2CH_2SCH_2CH_2SH)_3$ $CH_3OCOCH_2SCH_2CH(CH_3)SCH_2CH(CH_3)SH$ $CH_3OCOCH_2CH_2SCH_2CH(CH_3)SCH_2CH(CH_3)SH$

Inventors can not explain the theory why the compound (I) having mercapto alkylthio group used in the present invention functions as an inhibitor to prevent deposition of cokes.

DESCRIPTION OF THE PREFERRED EMBODIMENTS

Figure 1:
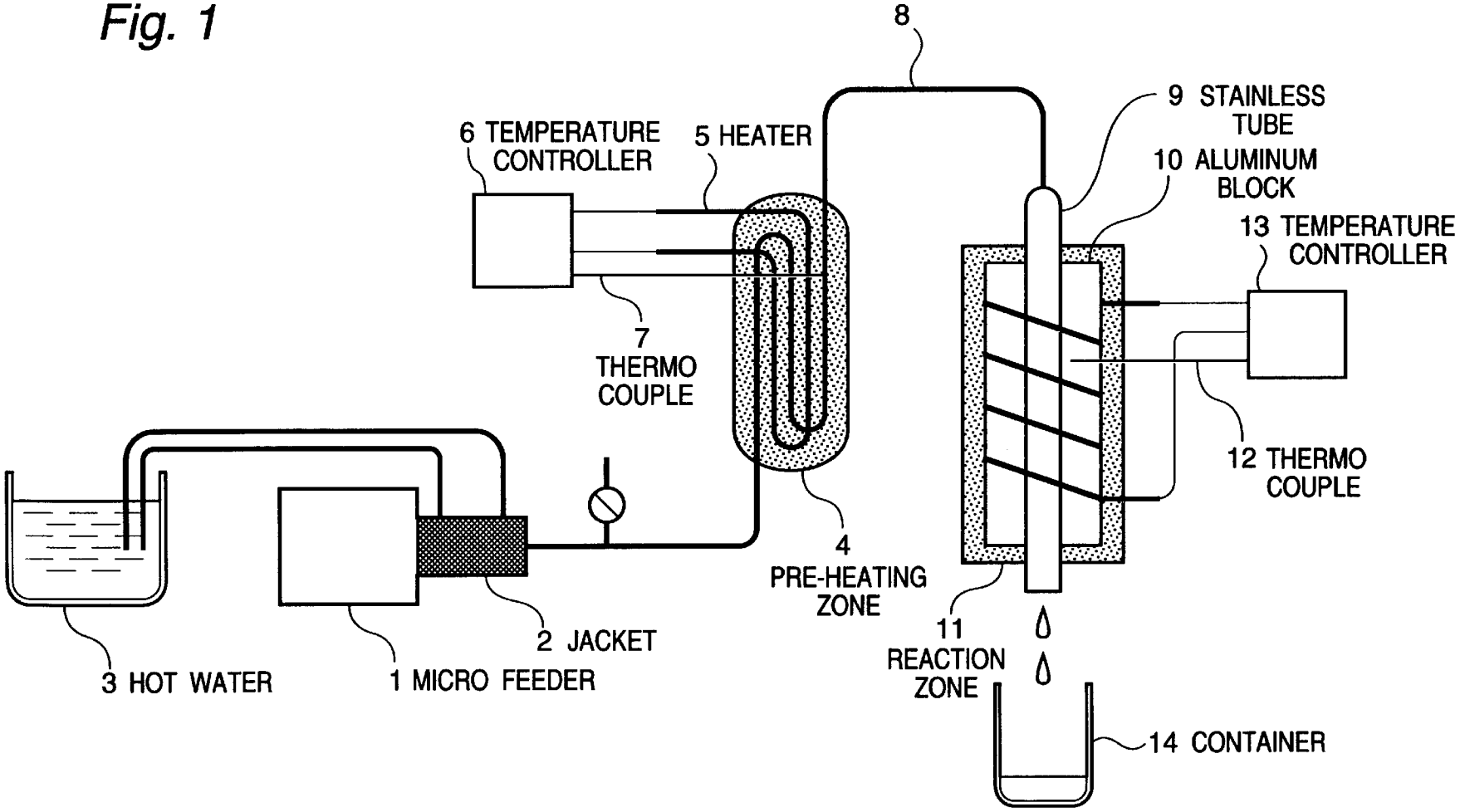
FIG. 1 illustrates a test unit for thermal cracking used in Examples of the present invention Now, examples of the present invention will be explained but the present invention is not limited to following illustrative examples.

Residue obtained from the bottom of atmospheric distillation column was heat-treated in a test unit shown in FIG. 1 in the presence or absence of additive according to the present invention to study the effect as inhibitor to prevent deposition of cokes.

As control sample, the residue of atmospheric distillation column was used. In comparative examples, the additive according to the present invention was replaced by other sulfur-containing compounds which were outside the present invention.

Each sample of the residue from atmospheric distillation column containing (or not containing) an additive was injected continuously into the test unit through a micro-feeder 1 which was heated by a jacket 2 through which hot water of 60 ° C. circulate from a hot water tank 3. The sample was heated in a pre-heating zone 4 covered by insulator and maintained at a temperature of 250 ° C. by a heater 5 which was controlled by temperature-adjuster 6 and thermocouple 7. The sample was fed through a stainless tube 8 having a diameter of ⅛ inch to a reaction zone 11 in which the stainless tube 8 was enlarged to a ¼ inch tube 9. This stainless tube 9 (length of 30 cm) was embedded in aluminum block 10 (diameter of 6 cm×height of 25 cm). The reaction zone 11 was further surrounded by an insulator and was kept at a temperature of 410 ° C. by a heater which was controlled by temperature-adjuster 13 and thermocouple 12.

The residence time of the residue from atmospheric distillation column in the reaction zone 11 was adjusted to 10 minutes which corresponds to a condition in actual vacuum distillation column.

Thus, the effect of the additive according to the present invention as inhibitor to prevent deposition of cokes was evaluated with the residue of atmospheric distillation column in the test unit shown in FIG. 1 which simulates a heating stage in actual oil refinery process.

The same test was carried out for the control sample of the same residue but contains no additive and for comparative examples in which the additive according to the present invention was replaced by sulfur-containing compounds which were outside the present invention.

EXAMPLE 1

Following compound "A" (a product of Nippon Shokubai Co., Ltd.) having mercapto alkylthio group was used as additive:

$$CH_3OCOCH_2CH_2SCH_2CH(CH_3)SH$$

The weight concentration of the additive added to the residue of atmospheric distillation column at was adjusted to 200 ppm.

The test was effected for 3 hours and then cokes deposited on inner surface of the stainless tube 9 was collected and washed with n-hexane. Collected cokes was dried and weighed to find cokes of 12.6 mg.

The same procedure as above was repeated for the control containing no additive to find cokes of 24.7 mg.

Comparing the results, it was revealed that the additive prevent or inhibit production of cokes. Tn fact, production of cokes was decreased by 49% [(24.7−12.6)/24.7=0.49] by the additive according to the present invention.

EXAMPLE 2

The same procedure as Example 1 was repeated but as additive a mixture "B" of following two compound (a) and (b) (products of Nippon Shokubai Co., Ltd.) (weight ratio= 1:1) was used:

(a) $(HOCH_2)C(CH_2OCOCH_2CH_2SCH_2CH_2SH)_3$ (b) $C(CH_2OCOCH_2CH_2SCH_2CH_2SH)_4$

Collected was 6.1 mg. This means that production of cokes was decreased drastically by 75% [(24.7−6.1)/24.7= 0.75] by the additive according to the present invention.

EXAMPLE 3

The same procedure as Example 1 was repeated but as additive a mixture "C" of following two compound (a) and (b) (products of Nippon Shokubai Co., Ltd.) (weight ratio= 9.1) was used:

(a) $CH_3OCOCH_2CH_2SCH_2CH_2SH$ (b) $CH_3OCOCH_2CH_2SCH_2CH_2SCH_2CH_2SH$

Collected was 10.8 mg. This means that production of cokes was decreased by 56% by the additive according to the present invention.

EXAMPLE 4

The same procedure as Example 1 was repeated but as additive a mixture "D" of following two compound (a) and (b) (products of Nippon Shokubai Co., Ltd.) (weight ratio= 9:1) was used:

(a) $CH_3OCOCH_2SCH_2CH(CH_3)SH$ (b) $CH_3OCOCH_2SCH_2CH(CH_3)SCH_2(CH(CH_3)SH$

Collected was 12.1 mg. This means that production of cokes was decreased by 51% by the additive according to the present invention.

COMPARATIVE EXAMPLE 1

The same procedure as Example 1 was repeated but as additive pentaerythritol tetrakis(3-mercapto propionate):

$$C(CH_2OCOCH_2CH_2SH)_4$$

(product of Elf Atochem S. A.) was used.

Collected was 13.5 mg. This means that production of cokes was decreased by 45% in this case.

COMPARATIVE EXAMPLE 2

The same procedure as Example 1 was repeated but as additive methyl-3-mercapto propionate:

$$CH_3OCOCH_2CH_2SH$$

(product of Elf Atochem S. A.) was used.

Collected was 15.7 mg. This means that production of cokes was decreased by 36% in this case.

COMPARATIVE EXAMPLE 3

The same procedure as Example 1 was repeated but as additive dimethyl disulfide:

$$CH_3SSCH_3$$

(product of Elf Atochem S. A.) was used.

Collected was 18.6 mg. This means that production of cokes was decreased by 25% in this case.

COMPARATIVE EXAMPLE 4

The same procedure as Example 1 was repeated but as additive dimethyl sulfide:

$$CH_3SCH_3$$

(product of Elf Atochem S. A.) was used.

Collected was 20.1 mg. This means that production of cokes was decreased by 19% in this case.

COMPARATIVE EXAMPLE 5

The same procedure as Example 1 was repeated but as additive 2-mercapto ethanol:

$$HOCH_2CH_2SH$$

(product of Elf Atochem S. A.) was used.

Collected was 21.4 mg. This means that production of cokes was decreased by 13% in this case.

The results are summarized in Table 1.

Table 1 reveals that the compounds (I) having mercaptoalkylthio group according to the present invention exhibit remarkable property to inhibit deposition of cokes comparing to other compounds used in Comparative Examples.

TABLE 1

| | Additive | cokes produced (mg) | decrement (%) |
|---|---|---|---|
| control | none | 24.7 | — |
| Example 1 | A* | 12.6 | 49 |
| Example 2 | B* | 6.1 | 75 |
| Example 3 | C* | 10.8 | 56 |
| Example 4 | D* | 12.1 | 51 |
| Comparative 1 | $C(CH_2OCOCH_2CH_2SH)_4$ | 13.5 | 45 |
| Comparative 2 | $CH_3OCOCH_2CH_2SH$ | 15.7 | 36 |
| Comparative 3 | $CH_3SSCH_3$ | 18.6 | 25 |
| Comparative 4 | $CH_3SCH_3$ | 20.1 | 19 |
| Comparative 5 | $HOCH_2CH_2SH$ | 21.4 | 13 |

A*: $CH_3OCOCH_2CH_2SCH_2CH(CH_3)SH$
B*: a mixture of $(HOCH_2)C(CH_2OCOCH_2CH_2SCH_2CH_2SH)_3$ and $C(CH_2OCOCH_2CH_2SCH_2CH_2SH)_4$ (1:1)
C*: a mixture of $CH_3OCOCH_2CH_2SCH_2CH_2SH$ and $CH_3OCOCH_2CH_2SCH_2CH_2SCH_2CH_2SH$ (9:1)
D*: a mixture of $CH_3OCOCH_2SCH_2CH(CH_3)SH$ and $CH_3OCOCH_2SCH_2CH(CH_3)SCH_2CH(CH_3)SH$ (9:1)

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

We claim:

1. Method for reducing deposition of cokes in heat-refining process of petroleum high-molecular hydrocarbons, comprising heat-treating in a heating unit effected in the presence of at least one compound (I) having at least one mercapto alkylthio group:

$HS—C_mH_{2m}—S—$ in which "m" is an integer of 2 to 4.

2. The method set forth in claim 1, wherein said compound (I) having mercapto alkylthio group is added at a proportion of 10 ppm to 1 % by weight with respect to petroleum hydrocarbons to be treated.

3. The method set forth in claim 1, wherein said heat-treatment is carried out in a temperature ranging from 250 ° C. to 550 ° C. and in a residence time of 1 to 60 min.

4. The method set forth in claim 1, wherein said compound (I) having mercapto alkylthio group is added to said petroleum hydrocarbons before the latter is introduced into said heating unit.

5. The method set forth in claim 1, wherein said compound (I) having mercapto alkylthio group is represented by the formula (A):

$$(R_1,R_2,R_3,R_4,R_5,R_6)—(S—C_mH_{2m}—SH)_n \quad (A)$$

in which

"m" is an integer of 2 to 4,

"n" is an integer of 1 to 6, and each of $R_1,R_2,R_3,R_4,R_5$, and $R_6$ is an organic group and optionally bonded each other through at least one chemical bond and at least one of $R_1,R_2,R_3,R_4,R_5$ and $R_6$ must exist in said compound, the total number of $R_1,R_2,R_3,R_4,R_5$, and $R_6$ being 2 to 28.

6. The method set forth in claim 1, wherein said heating unit is atmospheric distillation column, vacuum distillation column, thermal cracking unit or visbreaking unit.

7. Additive to reducing deposition of cokes in heating unit used in heat-refining process of petroleum high-molecular hydrocarbons, comprising at least one compound (I) having at least one mercaprtoalkylthio group:

$HS—C_mH_{2m}—S—$ in which "m" is an integer of 2 to 4.

8. The additive set forth in claim 7, wherein said compound (I) having mercapto alkylthio group is represented by the formula (A):

$$(R_1,R_2,R_3,R_4,R_5,R_6)—(S—C_mH_{2m}—SH)_n \quad (A)$$

in which

"m" is an integer of 2 to 4,

"n" is an integer of 1 to 6, and each of $R_1,R_2,R_3,R_4,R_5$ and $R_6$ is organic group and optionally bonded each other through at least one chemical bond, and at least one of $R_1,R_2,R_3,R_4,R_5$ and $R_6$ must exist in said compound, the total carbon number of $R_1,R_2,R_3,R_4,R_5$ and $R_6$ being 2 to 28.

9. Method for reducing deposition of cokes in heating unit used in heat-refining process of petroleum high-molecular hydrocarbons comprising adding to the heat-refining process a compound (I) having at least one mercaptoalkylthio group:

$HS—C_mH_{2m}—S—$ in which "m" is an integer of 2 to 4.

* * * * *